US010532390B2

(12) United States Patent
Zauhar et al.

(10) Patent No.: US 10,532,390 B2
(45) Date of Patent: Jan. 14, 2020

(54) FLOATING CLAMP RING ASSEMBLY

(71) Applicant: Pride Engineering, LLC, Minneapolis, MN (US)

(72) Inventors: Mark Zauhar, Minneapolis, MN (US); Russ Balamut, Minneapolis, MN (US); Dave Gadow, Minneapolis, MN (US)

(73) Assignee: Pride Engineering, LLC, Minneapolis, MN (US)

( * ) Notice: Subject to any disclaimer, the term of this patent is extended or adjusted under 35 U.S.C. 154(b) by 462 days.

(21) Appl. No.: 15/508,320

(22) PCT Filed: Sep. 1, 2016

(86) PCT No.: PCT/US2016/049895
§ 371 (c)(1),
(2) Date: Mar. 2, 2017

(87) PCT Pub. No.: WO2017/040780
PCT Pub. Date: Mar. 9, 2017

(65) Prior Publication Data

US 2017/0291209 A1 Oct. 12, 2017

Related U.S. Application Data

(60) Provisional application No. 62/213,408, filed on Sep. 2, 2015.

(51) Int. Cl.

| | |
|---|---|
| ***B21D 22/30*** | (2006.01) |
| ***B21D 22/28*** | (2006.01) |
| ***B21D 51/26*** | (2006.01) |

(52) U.S. Cl.
CPC ..... *B21D 22/30* (2013.01); *B21D 22/28* (2013.01); *B21D 51/26* (2013.01)

(58) Field of Classification Search
CPC ..... B21D 22/20; B21D 22/21; B21D 22/22; B21D 22/28; B21D 22/30; B21D 51/44; B21D 51/2661
See application file for complete search history.

(56) References Cited

U.S. PATENT DOCUMENTS

| | | | | |
|---|---|---|---|---|
| 4,503,702 A | | 3/1985 | Bulso, Jr. et al. | |
| 5,272,902 A | | 12/1993 | Kobak | |
| 5,797,292 A | | 8/1998 | Johansson et al. | |
| 6,058,753 A | * | 5/2000 | Jowitt | B21D 22/30 72/117 |
| 6,070,447 A | * | 6/2000 | Bone | B21D 22/30 72/348 |
| 6,351,980 B1 | * | 3/2002 | Jowitt | B21D 22/30 72/348 |
| 6,490,904 B1 | | 12/2002 | Zauhar | |
| 7,290,428 B2 | | 11/2007 | Zauhar | |

(Continued)

*Primary Examiner* — Pradeep C Battula
(74) *Attorney, Agent, or Firm* — Eggink & Eggink; Anthony G. Eggink; Katrina M. Eggink

(57) ABSTRACT

A clamp ring assembly for use in a can bottom forming assembly comprising a clamp ring retainer, a clamp ring having a biasing assembly and an inner dome die. The clamp ring floats with respect to the clamp ring retainer to accommodate off-center contact by the punch and to center the punch at the end of the ram stroke. A slightly conically shaped inner dome die structure or dome plug may be provided to further center the punch at the end of the ram stroke.

17 Claims, 3 Drawing Sheets

(56) References Cited

U.S. PATENT DOCUMENTS

| | | | | |
|---|---|---|---|---|
| 7,526,937 | B2 | 5/2009 | Zauhar | |
| 9,079,237 | B2 | 7/2015 | Fleischer et al. | |
| 2011/0179847 | A1* | 7/2011 | Pick ..... | B21D 22/30<br>72/351 |

* cited by examiner

FLOATING CLAMP RING ASSEMBLY

This application claims the benefit of U.S. Provisional Application Ser. No. 62/213,408, filed Sep. 2, 2015, and which is fully incorporated by reference herein.

BACKGROUND OF THE INVENTION

The present assembly relates generally to assemblies used in the manufacture of metal containers. Particularly, the assembly relates to a clamp ring retainer assembly for use in a bottom forming assembly used in the drawing and forming of the bottom portions of two piece steel and aluminum cans.

SUMMARY OF THE INVENTION

A clamp ring assembly which floats a clamp ring to respond to variations in bodymaker punch locations is disclosed. The clamp ring assembly is comprised of an arrangement of components to improve the centering and biasing control of the clamp ring and the inner dome die or dome plug. The clamp ring retainer is provided to house a floating clamp ring. A biasing assembly comprised of a multifaceted shaped compressible member or multiseal member and a cooperating slide ring are provided in a circumferential channel of the clamp ring for biasing or floating the clamp ring within a can bottom forming assembly. The multiseal or formed compressible member has a cross-sectional configuration which provides stable positioning of the slide ring and the multiseal member within the circumferential channel of the clamp ring. An improved dome plug or inner dome die is provided having a tapered side wall that allows clearance between the clamp ring and the dome die when the clamp ring is in its resting position and which aids to center the clamp ring when it is engaged by the punch. It is within the purview of exemplary embodiments, however, to utilize the floating clamp ring configuration within a bottom forming assembly having an inner dome die having straight side lines, thereby providing a tight fit with the clamp ring so that the inner dome die moves with the floating clamp ring.

Exemplary embodiments can improve manufacturing parameters by providing a more evenly distributed clamping force to control material flow as it is formed into the can bottom geometry when there is variation in the alignment of the punch with respect to the bottom former.

Exemplary embodiments can also provide a larger operating window with respect to punch/bottom former alignment while producing a can meeting desired specifications.

Exemplary embodiments can also provide spatial control of the clamp ring along and normal to the axis of ram movement to thereby provide for greater can manufacturing quality, production and efficiency.

These and other benefits of exemplary embodiments of floating clamp ring assemblies will become clear from the following description by reference to the drawings.

DESCRIPTION OF THE PREFERRED EMBODIMENTS

Figure 1:
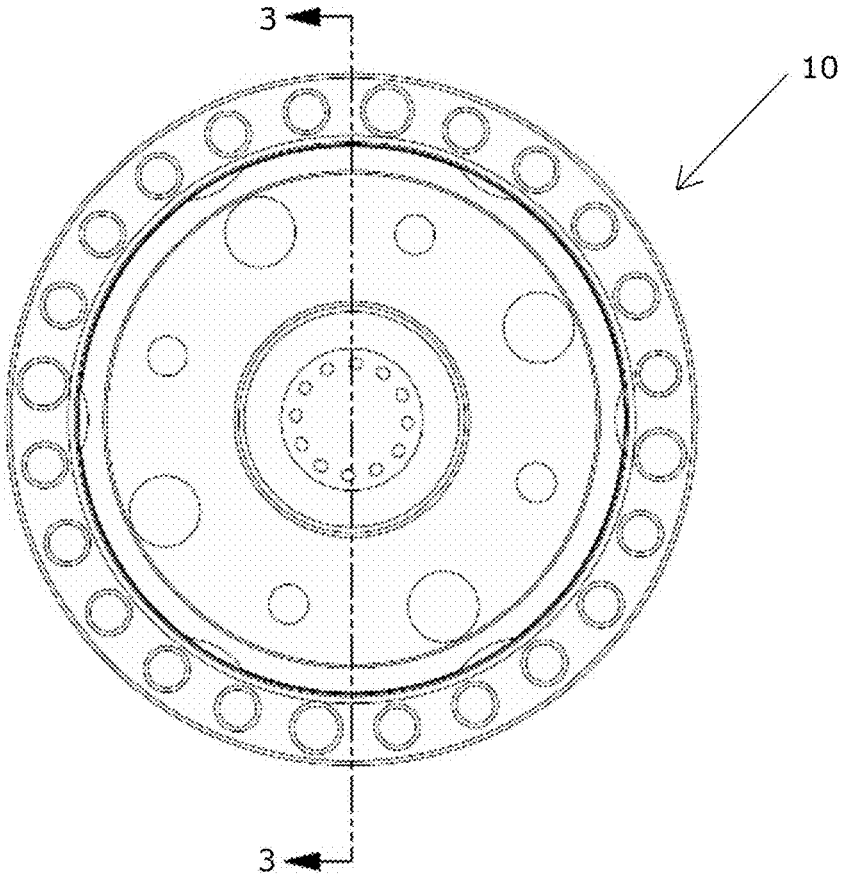
FIG. 1 is a front plan view of the clamp ring assembly.
Figure 2:
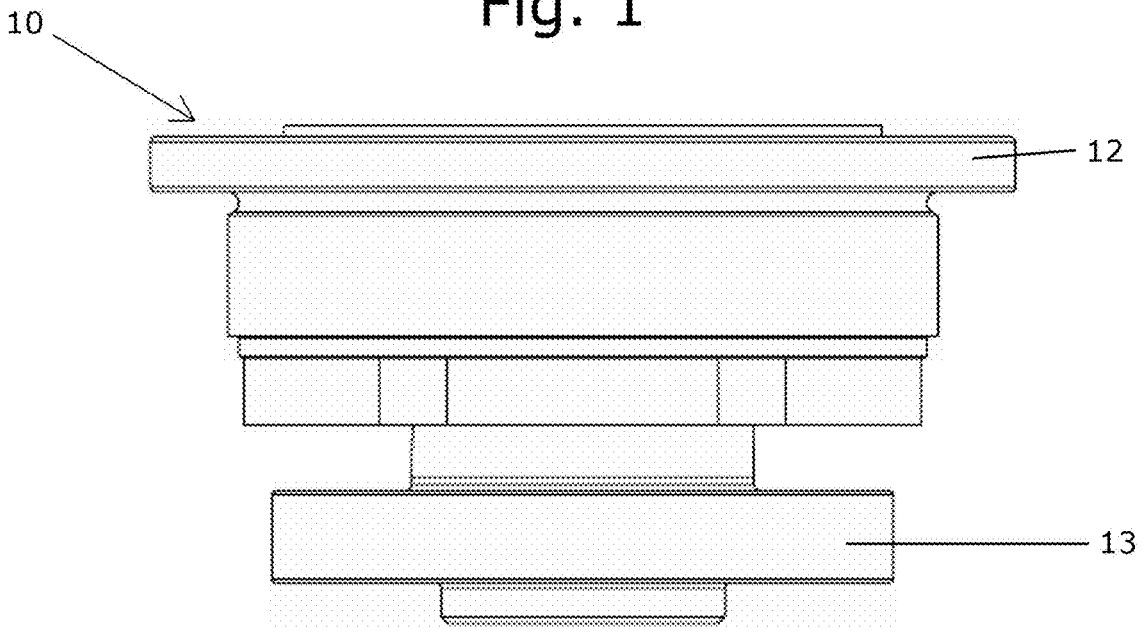
FIG. 2 is a top view of the clamp ring assembly.

A clamp ring assembly may be utilized in can bottom forming assemblies, for example, as disclosed in U.S. Pat. No. 4,930,330 ('330 patent), entitled Double Action Bottom Former, U.S. Pat. No. 6,490,904 B1 ('904 patent), entitled Double Action Bottom Former for High Cyclic Operation, U.S. Pat. No. 7,290,428 B2 ('428 patent), entitled Can Bottom Forming Assembly and in U.S. Pat. No. 7,526,937 B2 ('937 patent), entitled Can Bottom Forming Assembly, all owned via assignment by Applicant. The bottom former assemblies of the '330, '904, '428 and '937 patents, incorporated by reference herein, are constructed and arranged for cooperating use with a can bodymaker and specifically, the bodymaker punch carrying the can bodies. The '330, '904, '428 and '937 patents disclose dome plug positioning structures for can bottom forming assemblies.

The '330, '904, '428 and '937 patents describe can bottom forming processes including the action of the punch or ram of a can bodymaker assembly with respect to a bottom forming assembly. Bottom forming assemblies are typically constructed and arranged to cooperate with bodymaker assemblies. The bottom former receives can bodies on the rapid cycling bodymaker punch and forms two piece can body bottoms through a drawing and final forming process utilizing a clamp ring and dome plug. The term clamp ring is also known in the industry as a pressure ring, guide ring or outer die. The term dome plug is also known in the industry as an inner dome die or dome post. The specific manufacture of cans, beverage or food, may determine the use of the particular term.

In manufacturing a two piece can body, the walls of the can body are formed in a bodymaker assembly, the operation of which is described in the '330, '904, '428 and '937 patents which are incorporated by reference herein. Typically, a punch, i.e. from the bodymaker structure, carries the can body out of the tool pack to the clamp ring of the bottom forming assembly. In the improved bottom forming assemblies of the '428 and '937 patents, the clamp ring is constructed and arranged to float to thereby guide the punch to the center of the doming assembly and to re-center upon the exit of the punch. As the punch travels into the bottom forming assembly, the clamp ring structure axially centers the punch with the dome plug. When making two piece beverage cans, the clamp ring is used as a draw ring to apply pressure on the can material as it flows into the dome, thus controlling the material flow and preventing defects such as wrinkles. When making two piece food cans, the clamp ring acts as a guide member to align grooves in the punch with mating grooves in the inner die or dome plug.

Spatial control of the clamp or guide ring along and normal to the axis of ram movement is imperative for manufacturing quality, production and efficiency. The exemplary clamp ring assembly provides a more evenly distributed clamping force to control material flow as it is formed into the can bottom geometry when there is misalignment of the bottom former relative to the punch. Specifically, it provides a biasing assembly for the floating clamp ring that provides a higher initial resistive force than prior art clamp rings in order to reduce sagging of the clamp ring which could result in misalignment. Further, the configuration and combination of elements in the biasing assembly provides an increased life and reduced failure of the biasing assembly materials. Further, the configuration of the inner dome die or dome plug further aids in the spatial control of the clamp ring and ram. The clamp ring assembly and improved dome plug can thereby provide a larger operating window with respect to punch/bottom former alignment while producing a can meeting desired specifications.

The clamp ring assembly may be used in a bottom forming assembly which provides a floating clamp ring to center the ram or punch of a bodymaker and an inner dome die to accommodate greater ram or punch misalignment.

Figure 3:
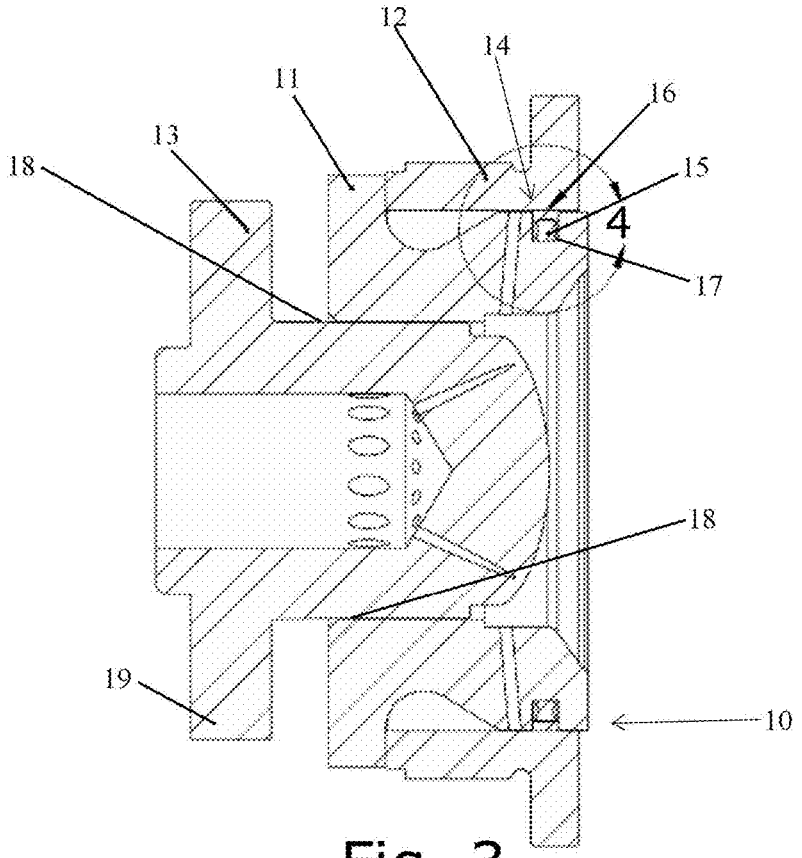
FIG. 3 is a sectional view of the clamp ring assembly of FIG. 1 taken along line 3-3.
Figure 4:
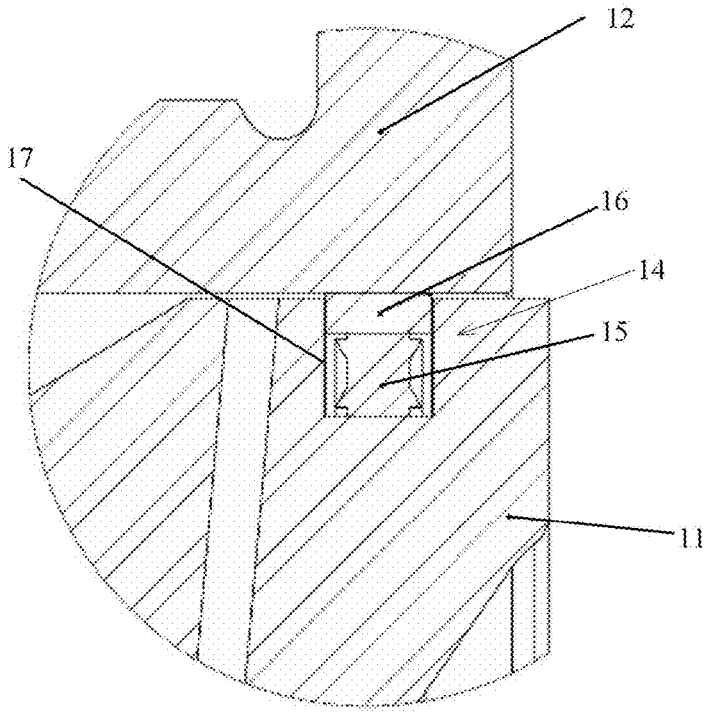
FIG. 4 is a close up sectional view of the clamp ring biasing element taken from section 4 of FIG. 3.
Figure 4A:
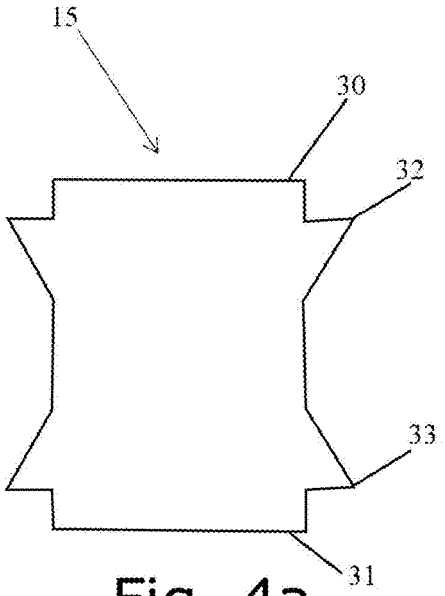
FIG. 4*a* is an enlarged sectional view of the multifaceted shaped member or multiseal member of FIG. 4.
Figure 5:
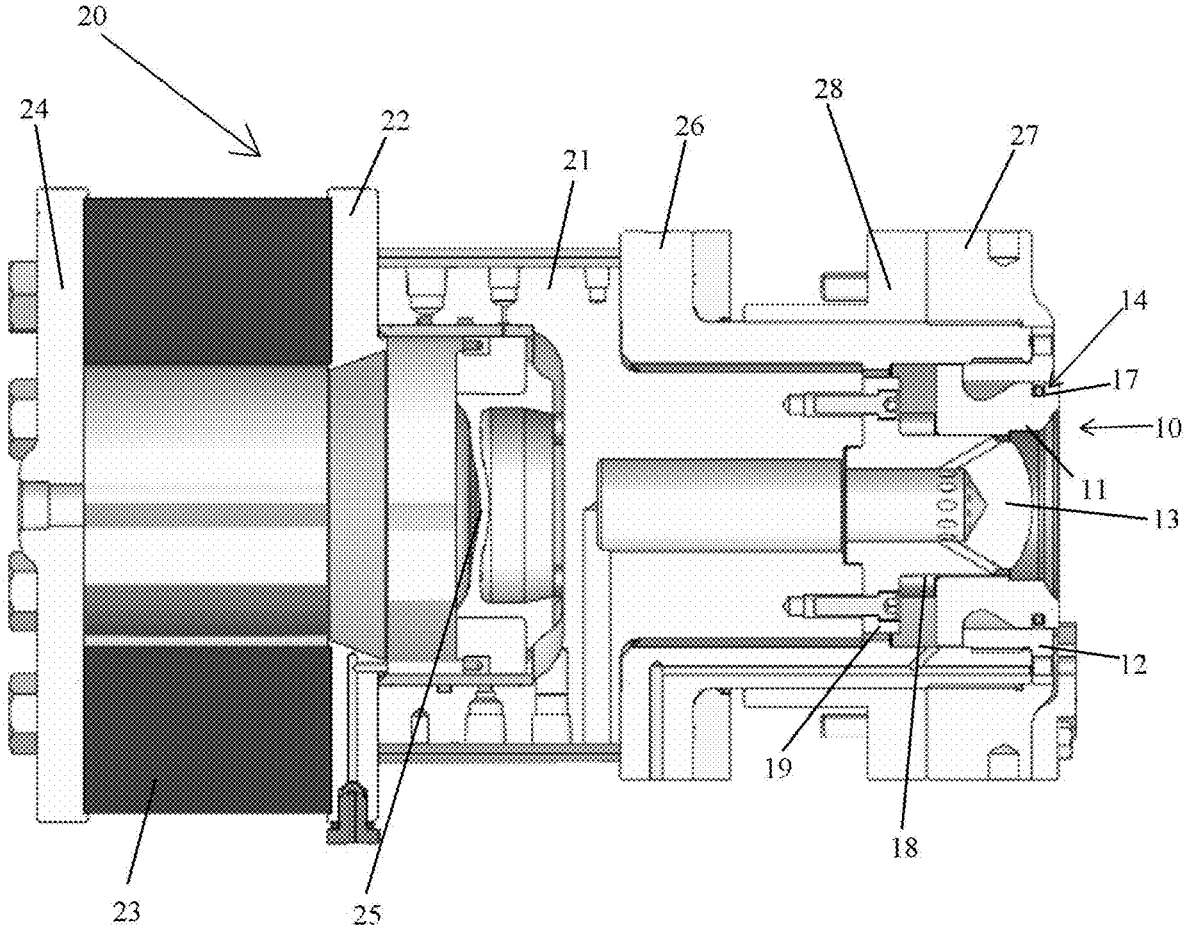
FIG. 5 is a lateral sectional view of a bottom forming assembly utilizing the clamp ring assembly.

The clamp ring assembly 10 is shown and described with respect to FIGS. 1-4*a* and is shown in use in a bottom forming assembly in FIG. 5.

Referring to FIGS. 1-4*a*, the clamp ring assembly 10 is comprised of an arrangement of components to improve the centering and biasing control of the clamp ring 11. The clamp ring retainer 12 is shown to house a floating clamp ring 11. A floating or biasing assembly 14 comprising a multifaceted compressible shaped member or multi seal member 15 and a cooperating slide ring 16 is provided for biasing or floating the clamp ring 11 within a can bottom forming assembly, the latter being disclosed, for example, in the above referenced '330, '904, '428 and '937 patents of Applicant. An inner dome die 13 is provided having a configuration to center the clamp ring 11 and to thereby further accommodate punch or ram misalignment.

Referring to FIG. 3, circumferential channel 17 is shown in clamp ring 11 and which is constructed and arranged to house biasing or floating assembly 14 which is shown comprised of slide ring 16 and cooperating multiseal member 15 which is seated within a circumferential slot of the slide ring 16. Slide ring 16 is made of a wear resistant material intended to provide a longer life than the O-ring interface material. For example, the slide ring 16 may be constructed of a polyether ether ketone thermoplastic (PEEK) or a like low-wear material. Multiseal member 15 is preferably constructed of a flexible compressible material and is constructed and arranged to compress radially. For example, the multiseal member 15 may be constructed of a fluoroelastomeric or like polymeric material. The latter material compositions may be formulated to function in high temperature conditions. The multifaceted shaped member or multiseal member 15 is shown having a multi-faceted cross sectional configuration, and is shown seated within the circumferential channel 17 of the clamp ring 11. By being able to compress radially, multiseal member 15 provides flexibility to allow contact from a misaligned punch to move the clamp ring 11 in a direction that improves its axial alignment with the punch and corresponding can body. The generally rectangular or multi-faceted shape of multiseal member 15 is shown in FIG. 4 and is utilized with the cooperating slide ring 16, as opposed to an O-ring as it increases the life of the material and prevents spiral failure of the material. Further multiseal member 15 provides greater surface area contact with slide ring 16 thereby providing a higher initial resistive force to reduce sagging of the clamp ring 11, which may result in misalignment.

As shown in FIG. 4*a*, the multiseal member 15 is shown in cross-section to have generally flat opposing end portions 30 and 31 and a pair of outwardly extending ridge members 32 and 33 therebetween. The configuration of the multiseal member 15 provides a stable positioning of the multifaceted shaped multiseal member 15 within the circumferential channel 17 of the clamp ring 11. The combination of the multiseal member 15 and the slide ring 16 preferably has a height whereby the dome plug 13 is aligned when the multiseal member 15 is not in a compressed state and the slide ring 16 touches the wall of the clamp ring retainer 12. As shown in FIG. 4*a*, the cross sectional configuration of the multiseal member IS shows the ability of the multifaceted shaped ring member to be stable in position when in the compressed and noncompressed state. The outwardly or axially extending ridge members 32 and 33 provide stability and allow the top, bottom and mid portions of multiseal member 15 to bulge outwardly when radially compressed, thereby providing for the integrity of the multifaceted shaped ring member structure 15.

As shown in FIG. 3, inner dome die 13 is shown having a tapered side wall 18 that allows clearance between clamp ring 11 and dome die 13 when the clamp ring is in its fully extended position prior to the punch, with can body, making contact. The clearance is equal to the amount of float designed into the slide ring interface. For example, the tapered side wall 18 may be disposed at an angle of approximately 91° with respect to flange 19 of inner dome die 13, with a preferred angle range of approximately 90.5-91.5°, or at an angle range of approximately 0.5-1.5° from the horizontal clamp ring inner wall as shown in FIG. 3. Tapered side wall 18 is designed to center clamp ring 11 progressively as the punch, with can body, moves the clamp ring until it is seated against flange 19 of dome die 13. The latter ensures that the final form of the can bottom has the features created by clamp ring 11 concentric with those created by dome die 13. It is possible, however, to utilize the floating clamp ring configuration within a bottom forming assembly having an inner dome die having straight side lines without a tapered sidewall, thereby providing a tight fit with the clamp ring so that the inner dome die moves with the floating clamp ring.

FIG. 5 shows the clamp ring retainer assembly 10 in use in a can bottom forming assembly 20. Clamp ring retainer 12, clamp ring 11 and dome die 13 are shown positioned within lock nut 27 at one end of assembly 20. Floating or biasing cooperating assembly 14 is shown positioned within channel 17 of clamp ring 11. Inner dome die 13 is shown having flange 19 and tapered side wall 18. Can bottom forming assembly 20 generally comprises a cylinder housing 21 forming axial chambers and housing piston 25. Cover plate 22 is shown adjacent cylinder housing 21 and donut spring 23. Spring end plate 24 is shown positioned adjacent the donut spring 23 and at the opposite end of assembly 20 as the floating clamp ring assembly 10. Outer housing 26 and mounting flange 28 are shown for mounting bottom forming assembly 20 with respect to can bodymaking equipment.

Clamp ring retainer assembly 10 can provide a more even clamping force to control material flow as it is formed into the can bottom geometry when there is misalignment of the punch with respect to the bottom former. The assembly 10 facilitates a larger operating window regarding punch/bottom former alignment, while producing a can meeting desired specifications.

As many changes are possible to the floating clamp ring assembly embodiments described and shown here, the descriptions above, and the accompanying drawing should be interpreted in the illustrative and not in the limited sense.

That which is claimed is:

1. A clamp ring assembly for use in a can bottom former, said clamp ring assembly comprising:

a) a clamp ring retainer;

b) a clamp ring having a circumferential channel for holding cooperating biasing members; and c) an inner dome die having a flange and a tapered side wall and wherein said tapered side wall of said inner dome die is disposed at an angle range of about 90.5 to 91.5° with respect to said flange to thereby form a slightly conical shape of said inner dome die.

2. The clamp ring assembly of claim 1, wherein said cooperating biasing members of said clamp ring comprise a slide ring and a multiseal member.

3. The clamp ring assembly of claim 2, wherein said multiseal member has a multi-faceted cross-sectional configuration.

4. The clamp ring assembly of claim 3 wherein said multiseal member is constructed of a fluoroelastomer.

5. A clamp ring assembly for a can bottom forming assembly having a body maker with a movable ram attached thereto, said clamp ring assembly comprising a clamp ring retainer, a clamp ring and an inner dome die, said clamp ring having a circumferential channel therein and a cooperating biasing assembly positioned within said circumferential channel, said biasing assembly comprising a multiseal member and a cooperating slide ring, thereby allowing said clamp ring to be movable with respect to said clamp ring retainer and said inner dome die.

6. The clamp ring assembly of claim 5, wherein said multiseal member is substantially compressible in at least a radial direction.

7. The clamp ring assembly of claim 5, wherein said multiseal member comprises at least two generally flat opposing end portions and at least two axially extending ridge members.

8. The clamp ring assembly of claim 7, wherein said multiseal member has a peripheral ridge and is constructed of a fluoroelastomer.

9. The clamp ring assembly of claim 7, wherein said multiseal member has two end portions and a mid portion and a pair of spaced peripheral ridges defining said midportion and wherein said peripheral ridges are in a touching relationship in said circumferential channel of said clamp ring when in an uncompressed state and wherein said mid portion is constructed and arranged to bulge outwardly toward said circumferential channel when in a compressed state.

10. The clamp ring assembly of claim 5, wherein said inner dome die has a tapered side wall to thereby provide clearance between said clamp ring and said dome die when said clamp ring is in an extended position.

11. The clamp ring assembly of claim 10, wherein said inner dome die further has a flange and wherein said tapered side wall of said inner dome die is disposed at an angle range of about 90.5 to about 91.5° with respect to said flange to thereby form a slightly conical shape of said inner dome die.

12. The clamp ring assembly of claim 11, wherein said tapered side wall of said inner dome die is disposed at an angle of approximately 91° with respect to said flange.

13. A clamp ring assembly for a can bottom forming assembly having a body maker with a movable ram attached thereto, said clamp ring assembly comprising a clamp ring retainer, a clamp ring and an inner dome die, said clamp ring having a biasing assembly and wherein the clamp ring is movable with respect to said clamp ring retainer and said inner dome die, said clamp ring having a circumferential channel and said biasing assembly comprising a multiseal member and a cooperating slide ring positioned within said circumferential channel and further wherein said inner dome die has a flange and a tapered side wall to thereby provide clearance between said clamp ring and said dome die when said clamp ring is in an extended position.

14. The clamp ring assembly of claim 13, wherein said multiseal member is substantially compressible in at least a radial direction.

15. The clamp ring assembly of claim 14 wherein said multiseal member has a peripheral ridge and is constructed of a fluoroelastomer.

16. The clamp ring assembly of claim 13, wherein said multiseal member comprises at least two generally flat opposing end portions and at least two axially extending ridge members.

17. The clamp ring assembly of claim 13, wherein said tapered side wall is disposed at an angle of approximately 91° with respect to said flange of said inner dome die.

* * * * *